United States Patent [19]

Fukuda

[11] Patent Number: 4,589,517

[45] Date of Patent: May 20, 1986

[54] MUFFLER

[75] Inventor: Masuo Fukuda, Omiya, Japan

[73] Assignee: Saikei Giken Kogyo Kabushiki Kaisha, Tokyo, Japan

[21] Appl. No.: 667,719

[22] Filed: Nov. 2, 1984

[30] Foreign Application Priority Data

Nov. 30, 1983 [JP] Japan ..... 58-185317[U]
Feb. 24, 1984 [JP] Japan ..... 59-32635

[51] Int. Cl.[4] ..... F01N 1/10

[52] U.S. Cl. ..... 181/265; 181/256; 181/258; 181/272

[58] Field of Search ..... 181/231, 244, 248–255, 181/257, 264, 265, 268, 258, 275, 272, 280, 256; 55/276, DIG. 20

[56] References Cited

U.S. PATENT DOCUMENTS 2,185,584 1/1940 Boyce ..... 181/252 X
2,326,612 8/1943 Bourne ..... 181/252
2,904,125 9/1959 Bourne et al. ..... 181/248
3,166,382 1/1965 Purse et al. .
3,174,583 3/1965 Giordano ..... 181/252
3,960,509 6/1976 Abriany ..... 181/276 X
4,360,076 11/1982 Suyama ..... 181/265
4,444,288 4/1984 Sekiya et al. ..... 181/252 X

*Primary Examiner*—Benjamin R. Fuller
*Attorney, Agent, or Firm*—Birch, Stewart, Kolasch & Birch

[57] ABSTRACT

A muffler for an internal combustion engine for effectively damping noise over a wide frequency range, from low frequency noise to high frequency noise. An absorber packed type muffler adapted to absorb noise by a sound absorbing material is inserted in and fixed to a housing which has a bore or bores thereinside, thereby forming one of a pipe inserted type muffler, a resonance type muffler and an interference type muffler to attain combined characteristics of both the types of mufflers.

16 Claims, 8 Drawing Figures

MUFFLER

BACKGROUND OF THE INVENTION

1. Field of the Invention

The present invention relates to a muffler for damping noise entailed by the emission of exhaust gases from an exhaust system of an internal combustion engine and, more particularly, to a high performance muffler and for an internal combustion engine which effectively dampens noise over a wide frequency range, including low frequency noises to high frequency noise.

2. Description of the Prior Art

Mufflers of the kind described may generally be classified into two types, i.e., a type having a sound absorbing material or absorbent packed therein and a type having pipes inserted therein. The first-mentioned type of muffler, generally referred to as an absorbent type muffler, shows a satisfactory degree of damping performance against high frequency noise but not against low or medium frequency noise. The second-mentioned type of muffler, referred to as a pipe insertion type muffler hereinafter, is effective to damp noise over an acceptable frequency range due to damping by combined expansion and resonance. Nevertheless, prior art mufflers of the absorbent type or the pipe insertion type are not fully acceptable.

SUMMARY OF THE INVENTION

It is therefore an object of the present invention to provide an improved muffler for use with an exhaust system of an internal combustion engine.

It is another object of the present invention to provide a muffler which effectively damps noise over a considerable frequency range, from low frequency noise to high frequency noise.

It is another object of the present invention to provide a muffler for an internal combustion engine which is simple in construction and, therefore, producible at low costs.

According to the present invention, a muffler assembly for admitting gases accompanied by noise thereinto to dampen the noise comprises an absorbent type muffler for admitting the gases thereinto to absorb the noise by means of a sound absorbing member, and a housing member formed with at least one bore. The absorbent type muffler is disposed in and fixed to the housing member.

In accordance with the present invention, a muffler for an internal combustion engine effectively damps noise over a wide frequency range, from low frequency noise to high frequency noise. An absorbent type muffler adapted to absorb noise by a sound absorbing material is inserted in and fixed to a housing which has a bore or bores thereinside, thereby forming one of a pipe insertion type muffler, a resonance type muffler, and an interference type muffler to attain combined characteristics of both types of mufflers.

BRIEF DESCRIPTION OF THE DRAWINGS

The objects and features of the present invention will become more apparent from a consideration of the following detailed description taken in conjunction with the accompanying drawings in which.

DESCRIPTION OF THE PREFERRED EMBODIMENTS

Figure 1:
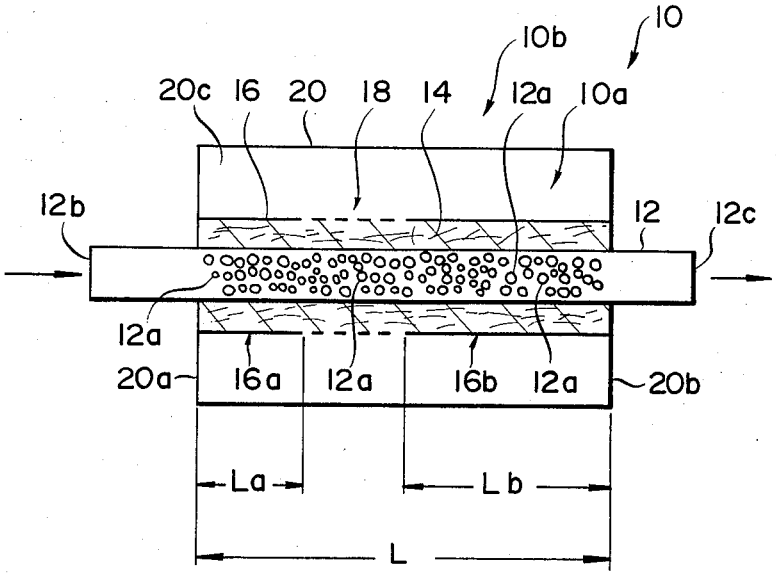
FIG. 1 is a vertical section of a basic construction of an absorbent type muffler embodying the present invention.

Referring to FIG. 1 of the drawings, a basic construction of an absorbent type muffler embodying the present invention is shown. The muffler, generally 10, includes a perforated pipe 12 which is perforated with a number of holes **12*a* through its wall and an inlet 12*b* and an outlet 12*c* at its opposite ends. A heat resisting, sound absorbing member, or absorbent, 14 is wound around the perforated pipe 12 over a length of the latter where the holes 12*a* are formed. The absorbent 14 may be made of glass wool, rock wool, slag wool, asbestos fibers, etc. The outer periphery of the absorbent 14 is covered with a retainer tube, or outer tube, 16 which is locally provided with an open, communication section 18 constituted by a number of holes (no numeral). In short, the muffler 10 in accordance with the present invention comprises an absorbent type muffler 10*a* made up of the perforated pipe 12, absorbent 14, and retainer tube 16**.

The absorbent type muffler **10*a* is disposed in a bore 20*c* of a tubular housing 20 which is closed by end plates 20*a* and 20*b* at opposite ends, respectively, the bore 20*c* serving as an expansion chamber. The perforated pipe 12 of the muffler 10*a* is supported by the end plates 20*a* and 20*b*, constituting, as a whole, a pipe insertion type muffler 10*b*. That is, in the illustrated construction, a non-communication section 16*a* of the retainer tube 16 at the inlet side of the retainer tube 16 and adjacent to the end plate 20*a* functions as an inserted inlet pipe, while at the outlet side of the tube 16 a non-communication section 16*b* adjacent to the end plate 20*b*** functions as an inserted outlet pipe.

As described above, the muffler shown in FIG. 1 is comprised of the combination of the absorbent type muffler **10*a* and the pipe insertion type muffler 10*b*** and, therefore, attains their characteristics at the same time.

In the illustrative embodiment, assuming that the overall length of the tubular housing 20 is L and the lengths of the non-communication sections **16*a* and 16*b* of the retainer tube 16 are La and Lb, respectively, they may be suitably selected to effectively damp noise in conformity to particular characteristics of an intended internal combustion engine. This in turn allows the communication section 18 of the retainer tube 16** to be positioned and dimensioned in a desired manner. For specific numerical values, a reference may be made to Japanese Utility Model Publication Nos. 57-30401/1982 and 57-52372/1982, for example.

The communication section 18 of the retainer tube 16 may comprise a meshing instead of the numerous holes shown and described. Concerning the absorbent 14 wound around the perforated pipe 12, its thickness has little influence on the resulting sound absorbing effect if the volume of the expansion chamber **20*c*** is constant; typically, the thickness may be 5, 8, 15 or 30 millimeters.

For noise in the medium frequency range, however, a thicker absorbent would achieve greater performance in sound absorption. In the illustrative embodiment, the absorbent 14 is 8 millimeters thick by way of example.

While in the embodiment of FIG. 1 the pipe insertion type muffler 10*b* is constructed by combining the muffler 10*a* made up of the perforated pipe 12, absorbent 14, and retainer tube 16, and the tubular housing 20 having the single expansion chamber 20*c*, it is naturally permissible to combine such a muffler 10*a* with a tubular housing having a plurality of expansion chambers.

Figure 2:
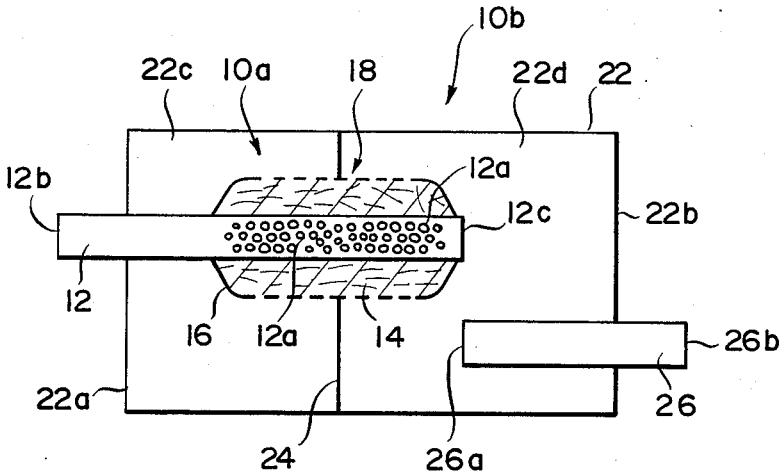
FIGS. 2–6 are vertical sections each showing a possible arrangement in accordance with the present invention in which an absorbent type muffler with the basic construction shown in FIG. 1 is combined with a pipe insertion type muffler.

For example, in an alternative construction shown in FIG. 2, a tubular housing 22 is divided by a partition 24 into two compartments, i.e. a first expansion chamber 22*c* and a second expansion chamber 22*d*. An absorbent type muffler 10*a* with the basic construction shown in FIG. 1 is inserted in the first and second expansion chambers 22*c* and 22*d* of the housing 22 and securely mounted to the housing 22 by an end plate 22*a* and the partition 24. Specifically, the perforated pipe 12 is supported by the end plate 22*a* adjacent to its inlet 12*b* and the retainer tube 16 is supported by the partition 24 such that its communication section 18 is open to expansion chambers 22*c* and 22*d*. The inlet 12*b* for the entry of engine exhaust is open to the atmosphere and the outlet 12*c* to the second expansion chamber 22*d*. Meanwhile, the other end plate 22*b* in FIG. 2 rigidly carries therewith an outlet pipe 26 having an inlet 26*a* and an outlet 26*b*, so that gases admitted into the second expansion chamber 22*d* are discharged to the atmosphere via the outlet 26*b*. Again, the muffler in this particular embodiment has both the characteristic of an absorbent type muffler and that of a pipe insertion type muffler.

Figure 3:
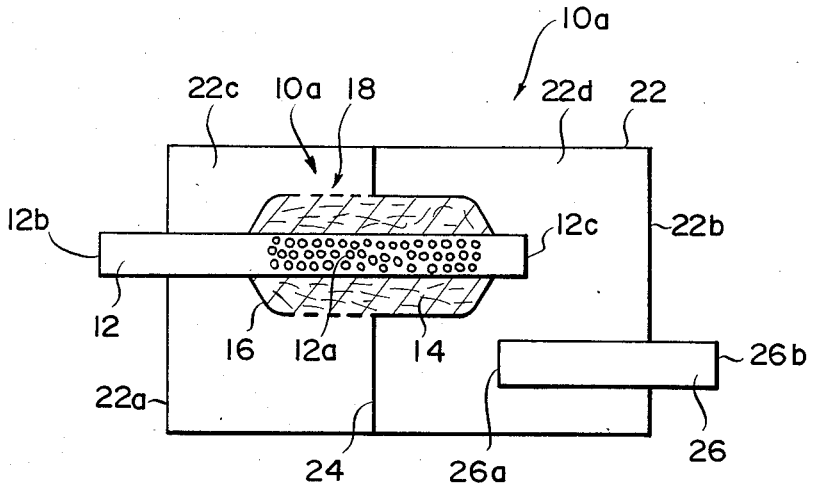

A modification to the construction shown in FIG. 2 is shown in FIG. 3. The difference between the two constructions is that in FIG. 3 the absorbent type muffler 10*a* is mounted to the housing 22 such that the communication section 18 of the retainer tube 16 is open to the first expansion chamber 22*c* only.

Figure 4:
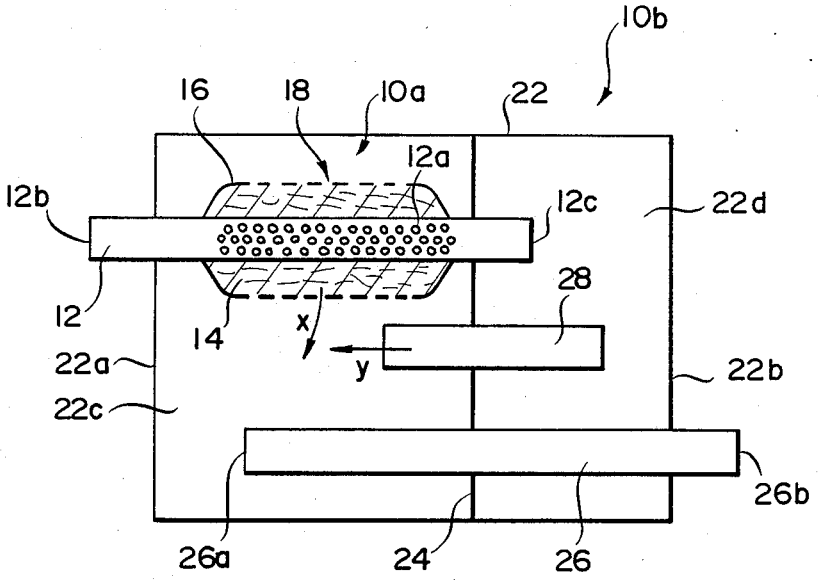

Another modification to the construction shown in FIG. 2 is shown in FIG. 4. In FIG. 4, the perforated pipe 12 is supported by the end plate 22*a* adjacent to the inlet 12*b* and by the partition 24 adjacent to the outlet 12*c*, the inlet 26*a* of the outlet pipe 26 is open to the first expansion chamber 22*c*, and instead a pipe 28 for fluid communication between the expansion chambers 22*c* and 22*d* is supported by the partition 24. In this particular construction, gaseous streams x emanating from the holes of the communication section 18 and accompanying noise and those y emanating from the pipe 28 interfere with each other, offering further effective noise reduction.

Figure 5:
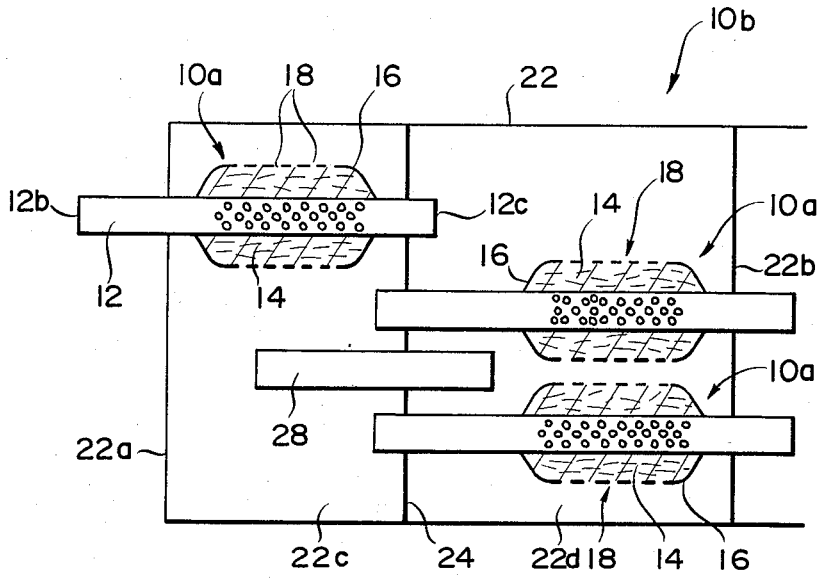

Referring to FIG. 5, a modification to the muffler shown in FIG. 4 is shown in which two absorbent type mufflers 10*a* are installed in the second chamber 22*d* in the same manner as the muffler 10*a* in the first expansion chamber 22*c*. It will be noted that any desired number of such absorbent type mufflers 10*a* may be disposed in a housing having three or more partitioned compartments, or expansion chambers.

Figure 6:
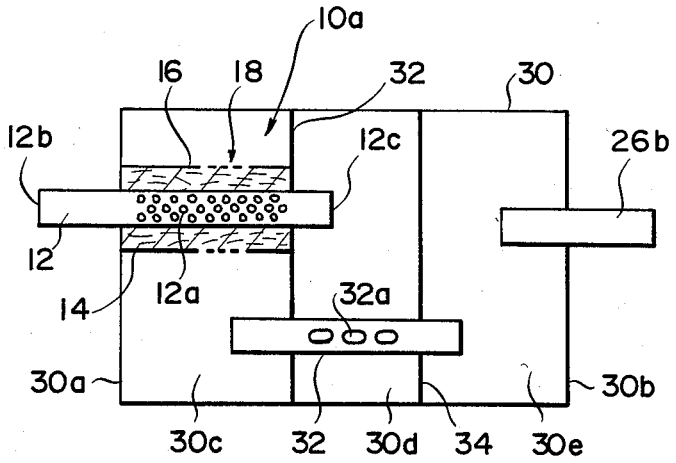

In another possible construction shown in FIG. 6, a tubular housing 30 having end plates 30*a* and 30*b* has its interior divided by two partitions 32 and 34 into three compartments, i.e. first to third expansion chambers 30*c*, 30*d* and 30*e*. The absorbent type muffler 10*a* shown in FIG. 1 is installed in the first expansion chamber 30*c* in exactly the same manner as shown in FIG. 1. That is, the outlet 12*c* of the perforated pipe 12 is open to the second expansion chamber 30*d*, and the holes of the communication section 18 to the first expansion chamber 30*c*. Further, a pipe 32 for fluid communication is installed in the housing 30 which is open at one end to the first expansion chamber 30*c* and at the other end to the third expansion chamber 30*e*. The pipe 32 is formed with a plurality of openings 32*a* in part thereof and rigidly held by the partitions 32 and 34.

Figure 7:
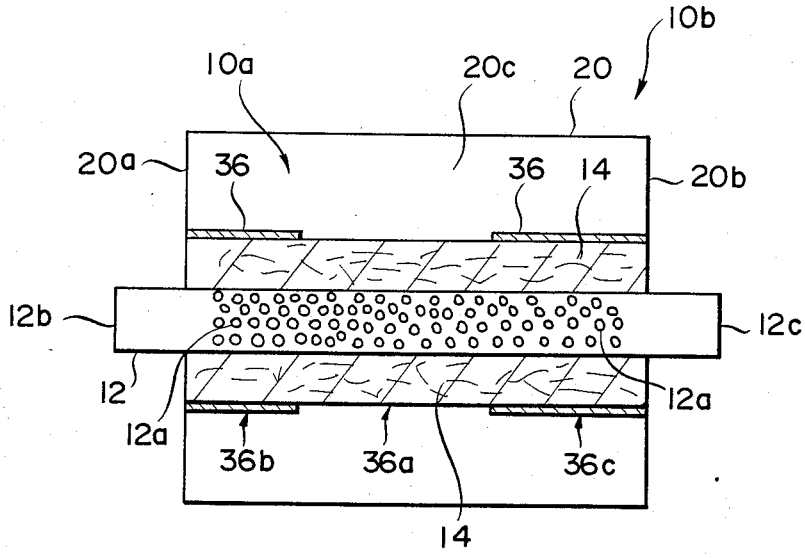
FIG. 7 is a vertical section of a second embodiment of the basic construction of the absorbent type muffler in accordance with the present invention.

Referring to FIG. 7, a second embodiment of the basic construction of the absorbent type muffler in accordance with the present invention is shown.

In the muffler shown in FIG. 7, the retainer tube 16 associated with the sound absorbing member 14 as shown in FIG. 1 is replaced by suitable covering members 36 which fluid-tightly cover part of the outer periphery of the member 14. The coverings 36 may be adhered by heat resisting binder, for example. Specifically, the member 14 is provided with a communication section 36*a* open to expansion chamber 20*c* and non-communication sections 36*b* and 36*c* isolated from the chamber 20*c*. As in the various constructions in accordance with the first embodiment shown in FIGS. 2–6, the absorbent type muffler 10*a* shown in FIG. 7 is applicable to a housing of the type having a plurality of expansion chambers therein, with a view to attaining the characteristics of both the absorbent type muffler and pipe insertion type muffler. Such may be implemented in essentially the same manner as in FIGS. 2–6 and, therefore, will not be shown or described for simplicity.

Figure 8:
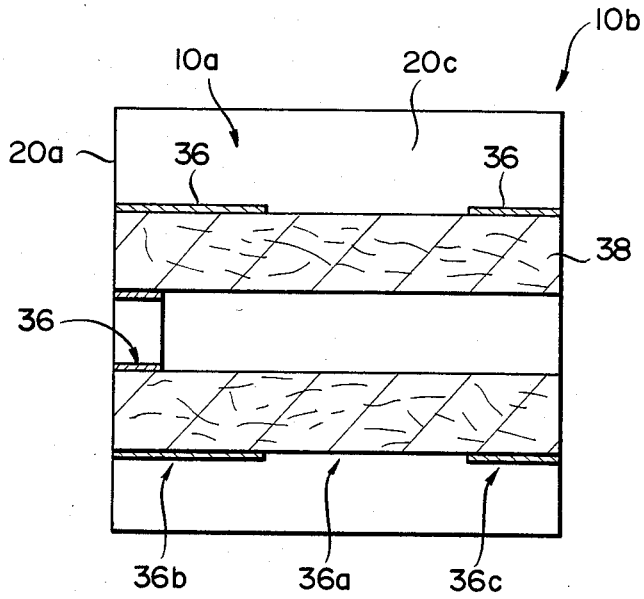
FIG. 8 is a vertical section of a third embodiment of the basic construction of the absorbent type muffler in accordance with the present invention.

Referring to FIG. 8, a third embodiment of the basic construction of the absorbent type muffler in accordance with the present invention is shown. In FIG. 8, the perforated pipe 12 shown in the second embodiment of FIG. 7 is omitted and replaced by a heat resisting, sound absorbing member 38 which for itself can hold a tubular shape. As in the embodiment of FIG. 7, the outer periphery of the sound absorbing member or absorbent 38 is partly covered fluid-tight by covering member 36 using heat resisting binder or the like; the member 38 is provided with a communication section 36*a* open to the expansion chamber 20*c* and non-communication sections 36*b* and 36*c* isolated therefrom. For the member 38, use may be made of porous foamed ceramic, foamed metal or the like. Even the inner periphery of the tubular member 38 may be partly sealed by such a covering member 36. If necessary, the perforated pipe 12 shown in the embodiment of FIG. 1 or that of FIG. 2 may be inserted in the member 38.

What is claimed is:

1. A muffler assembly for admitting gases accompanied by noise to dampen the noise, comprising:

a housing member generally cylindrical in shape having interior plates which are substantially perpendicular to the longitudinal axis of said housing member to define a plurality of chambers;

a muffler supported in said housing member, said muffler including:

gas induction means for admitting the gases at one end thereof and discharging a portion of said gases at the other end thereof into a second of said plurality of chambers, said gas induction means having a perforated section;

an air permeable sound absorbing member mounted around at least the perforated section of said gas induction means for allowing the remaining portion of said gas admitted into said gas induction means to be passed through said perforated section and said air permeable absorbing member to absorb the noise;

a retainer member having communication and non-communication wall sections formed for covering and supporting the outer periphery of said sound absorbing member, said communication section being formed to discharge the remaining portion of the admitted gases into the first of said plurality of chambers;

a pipe connecting said first and second chambers such that gases which have been discharged into the second chamber can pass through said pipe and back into said first chamber to interfere with the gases being discharged from said communication section of the retainer member; and means communicating with said first chamber for discharging gases from the first chamber to the atmosphere.

2. A muffler assembly in accordance with claim 1, wherein the gas induction means comprises a pipe formed with a number of apertures therethrough, the gas coming out through said apertures being inducted into the sound absorbing member.

3. A muffler assembly in accordance with claim 2, wherein the sound absorbing member comprises a heat resisting member.

4. A muffler assembly in accordance with claim 3, in which the heat resisting member is made of at least one of glass wool, rock wool, slag wool and asbestos fibers.

5. A muffler assembly in accordance with claim 2, wherein the sound absorbing member retainer member comprises a pipe which is formed with a plurality of apertures therethrough to constitute the communication section.

6. A muffler assembly in accordance with claim 2, wherein the sound absorbing member retainer member comprises a pipe part of which is formed by a meshing as the communication section.

7. A muffler assembly in accordance with claim 2, wherein the retainer member comprises a covering member the non-communication section of which comprises a sealing which covers a predetermined portion of the outer periphery of the sound absorbing member.

8. A muffler assembly in accordance with claim 7, wherein the covering member is adhered to the outer periphery of the sound absorbing member by heat resisting binder.

9. A muffler assembly in accordance with claim 1, wherein the sound absorbing member comprises a heat resisting member which automatically holds a shape thereof.

10. A muffler assembly in accordance with claim 9, wherein the heat resisting member is made of at least one of porous foamed ceramic and foamed metal.

11. A muffler assembly in accordance with claim 9, wherein the gas induction means comprises an inner tubular space defined in the tubular sound absorbing member.

12. A muffler assembly in accordance with claim 11, wherein the sound absorbing member retainer member comprises a covering member which sealingly covers a predetermined portion of the sound absorbing member to form the non-communication section.

13. A muffler assembly in accordance with claim 12, wherein the covering member is adhered by heat resisting binder to said predetermined portion of the sound absorbing member.

14. The muffler assembly according to claim 1, wherein the means communicating with said first chamber for discharging gases from said first chamber to the atmosphere is a pipe.

15. The muffler assembly according to claim 1, wherein the means communicating with said first chamber for discharging gases from the first chamber to the atmosphere comprises at least a second muffler supported in said second chamber, said second muffler including:

gas induction means for admitting gases at one end thereof from the first chamber and discharging a portion of said gases at the other end thereof to the atmosphere;

an air permeable sound absorbing member mounted around at least the perforated section of said gas induction means for allowing the remaining portion of the gases from the first chamber admitted into the gas induction means to be passed therethrough to absorb the noise;

a retainer member having communication and non-communication wall sections formed for covering and supporting the outer periphery of said sound absorbing member;

said communication section being formed to transfer gas to said second chamber to permit the discharge of the remaining portion of the admitted gases into the second chamber.

16. A muffler assembly for admitting gases accompanied by noise to dampen the noise, comprising:

a housing member generally cylindrical in shape having interior plates which are substantially perpendicular to the longitudinal axis of said housing member to define a plurality of chambers;

a muffler supported in said housing member, said muffler including:

gas induction means for admitting the gases at one end thereof and discharging at a portion of said gases at the other end thereof into a second of said plurality of chambers, said gas induction means having a perforated section;

an air permeable sound absorbing member mounted around at least the perforated section of said gas induction means for allowing the remaining portion of said gas admitted into said gas induction means to be passed through said perforated section and said air permeable absorbing member to absorb the noise;

a retainer member having communication and non-communication sections formed for covering and supporting an outer periphery of said sound absorbing member, said communication section being formed to discharge the remaining portion of the admitted gases into the first of said plurality of chambers;

a pipe having one end thereof communicating with a first of said plurality of chambers and the other end thereof communicating with a third of said plurality of chambers while extending through a second of said plurality of chambers, said pipe having a perforated section which communicates with said second of said plurality of chambers; and an exit pipe providing communication between the third chamber and the atmosphere.

* * * * *

UNITED STATES PATENT AND TRADEMARK OFFICE

CERTIFICATE OF CORRECTION

PATENT NO. : 4,589,517

DATED : May 20, 1986

INVENTOR(S) : Fukuda

It is certified that error appears in the above-identified patent and that said Letters Patent is hereby corrected as shown below:

On the title page

In category "[73] Assignee:", please change "Saikei Giken Kogyo Kabushiki Kaisha" to --Sankei Giken Kogyo Kabushiki Kaisha--.

Signed and Sealed this

Ninth Day of December, 1986

*Attest:*

DONALD J. QUIGG

*Attesting Officer*

*Commissioner of Patents and Trademarks*